US006171150B1

(12) United States Patent
Saito et al.

(10) Patent No.: US 6,171,150 B1
(45) Date of Patent: Jan. 9, 2001

(54) CONNECTOR

(75) Inventors: Masashi Saito; Takashi Koide; Masahiko Aoyama, all of Yokkaichi (JP)

(73) Assignee: Sumitomo Wiring Systems, Ltd. (JP)

( * ) Notice: Under 35 U.S.C. 154(b), the term of this patent shall be extended for 0 days.

(21) Appl. No.: 09/347,179

(22) Filed: Jul. 2, 1999

(30) Foreign Application Priority Data

Jul. 6, 1998 (JP) ..... 10-190832

(51) Int. Cl.[7] ..... H01R 9/03
(52) U.S. Cl. ..... 439/610; 439/607; 439/352
(58) Field of Search ..... 439/610, 752, 439/595, 98, 95, 188, 578, 607, 608, 609, 108

(56) References Cited

U.S. PATENT DOCUMENTS

| | | | | |
|---|---|---|---|---|
| 5,169,340 | | 12/1992 | Nakata et al. | 439/607 |
| 5,171,166 | * | 12/1992 | Sato et al. | 439/578 |
| 5,529,506 | * | 6/1996 | Onoda | 439/95 |
| 5,580,268 | | 12/1996 | Miyazawa | 439/352 |
| 5,651,704 | * | 7/1997 | Fukushima et al. | 439/752 |
| 5,741,162 | * | 4/1998 | Kourimsky et al. | 439/748 |
| 5,766,041 | | 6/1998 | Morin et al. | 439/609 |

FOREIGN PATENT DOCUMENTS

| | | |
|---|---|---|
| 0 732 780 | 9/1996 | (EP) . |
| 2 747 846 | 10/1997 | (FR) . |

* cited by examiner

*Primary Examiner*—Paula Bradley
*Assistant Examiner*—Alexander Gilman
(74) *Attorney, Agent, or Firm*—Anthony J. Casella; Gerald E. Hespos; Michael J. Porco

(57) ABSTRACT

A connector is provided with a ground terminal, and a side type retainer is mountable in the connector. A connection element receptacle 20 for accommodating an electrical connection element 3 is provided inside a connector housing 2. A retainer 4 for locking the electrical connection element 3 is mounted in a retainer mount hole 25 formed in the upper surface of the connector housing 2. Further, a ground terminal receptacle 29 for accommodating a ground terminal 5 is provided in the bottom wall of the connection element receptacle 20. In this way, since the retainer 4 is assembled at the side of the electrical connection element 3 opposite from the ground terminal 5, it can be constructed as a so-called side retainer.

10 Claims, 19 Drawing Sheets

CONNECTOR

BACKGROUND OF THE INVENTION

1. Field of the Invention

The present invention relates to a connector, and particularly a connector for high frequency signals.

2. Description of the Related Art

A prior art connector is identified by the numeral 100 in FIGS. 31 to 35, and is disclosed in Japanese Unexamined Utility Model Publication No. 5-27983. The prior art connector 100 is for high frequency signals and is to be connected with one end of an unillustrated shielded cable. The connector 100 is comprised of electrical connection elements 101, a retainer 102, and a ground terminal 103.

The shielded cable is comprised of a core wire inside and a shield layer for surrounding the core wire. Although not shown in detail, each electrical connection element 101 is provided with two kinds of terminal fittings: an inner terminal to be connected with the core wire and an outer terminal to be connected with the shield layer.

The retainer 102 is inserted into the connector housing 104 from behind (direction of an arrow A in FIG. 31), whereas the ground terminal 103 is mounted from underneath the connector housing 104 (direction of an arrow B in FIG. 33).

In general, side type retainers, which are mounted in a direction normal to the mounting direction of the electrical connection elements 101, are preferred since they have a strongest force to lock the terminals.

The conventional retainer 102 is a rear type retainer which is mounted in the same direction as the electrical connection elements 101. However, its force to lock the electrical connection elements 101 is smaller than the locking force of the side type retainer.

Use of the side type retainer with the connector housing 104, will cause the retainer and the ground terminal 103 to interfere with each other if a mount hole for the retainer is provided in a side surface of the connector housing 104. This interference occurs because the ground terminal 103 is mounted in a direction normal to the mounting direction of the electrical connection elements 101. Accordingly, it is difficult to provide the mount hole for the retainer.

In view of the above problem, an object of the present invention is to provide a connector having a ground terminal, in which connector a side type retainer is mountable.

SUMMARY OF THE INVENTION

According to the invention, there is provided a connector, comprising an electrical connection element and a connector housing. The housing comprises a connection element receptacle for substantially accommodating the electrical connection element that is connected with the leading end of a shielded cable. The connector also has a ground terminal to be mounted in a ground terminal receptacle that substantially communicates with the connection element receptacle so as to be brought into contact with one side surface of the electrical connection element. A retainer mount hole is formed in one side surface of the connector housing and communicates with the connection element receptacle at a side opposite the side the ground terminal. A retainer is insertable into the retainer mount hole to lock the electrical connection element.

Accordingly, since the retainer is assembled at the side of the electrical connection element opposite from the ground terminal, it can be constructed as a so-called side retainer.

It is empirically known that a contact portion between the ground terminal and the electrical connection element is better to be a surface than to be a point since the surface contact ensures a satisfactory high frequency characteristic. A surface contact portion can be an elastic contact piece, which more easily tolerates a molding error of the connector than a mere projection. An attempt can be made to provide a ground terminal that is inserted from one side of the connector housing with an elastic contact piece as in the prior art. However the transverse dimension of the connector housing has to be increased due to the necessity to provide a deformation permitting space for the insertion of the ground terminal.

According to a preferred embodiment of the invention, the ground terminal comprises an elastic contact piece which can be brought elastically into surface contact with the electrical connection element. Accordingly, the ground terminal receptacle is open in the rear surface of the connector housing.

Preferably, the elastic contact piece is deformable in a space defined between the connection element receptacle and the ground terminal receptacle. Accordingly, the deformation permitting space for the elastic contact piece takes advantage of the connection element receptacle, and the elastic contact piece easily can be provided on the ground terminal without increasing the size of the connector housing.

The ground terminal may be provided with at least one push-in portion which can be pushed into a slot provided in the ground terminal receptacle, and the elastic contact piece is formed on the push-in portion, preferably by bending.

Most preferably, the push-in portion is fitted into a notch being provided in the connector housing when the ground terminal is mounted in the ground terminal receptacle, so that the elastic contact piece substantially faces the connection element receptacle. Accordingly, the connector can be made stable and compact.

According to a further preferred embodiment of the invention, the electrical connection element comprises an inner terminal to be connected with a core wire of the shielded cable, an outer terminal to be connected with a shield of the shielded cable, and an insulating member for insulating the inner and outer terminals from each other.

Preferably, the outer terminal comprises push-in portions which project sideways from the outer terminal and can be pushed into grooves formed in inner walls of the connection element receptacle, and the retainer locks the electrical connection element by being engaged with the push-in portions. Accordingly, since the electrical connection element is comprised of the inner terminal, the outer terminal, and the insulating member provided between the outer and inner terminals, it is difficult to provide a locking portion that projects into the space inside the outer terminal, as in a side retainer of a usual connector. Thus, by forming the push-in portions to project from the outer terminal of the electrical connection element and by using the push-in portions to lock the retainer, a structure that projects into the inner space of the outer terminal can be avoided. Furthermore, since the push-in portions are pushed into the grooves of the connection element receptacle, they also contribute to the stable mounting of the electrical connection element.

These and other objects, features and advantages of the present invention will become more apparent upon a reading of the following detailed description and accompanying drawings.

DETAILED DESCRIPTION OF THE PREFERRED EMBODIMENTS

Figure 1:
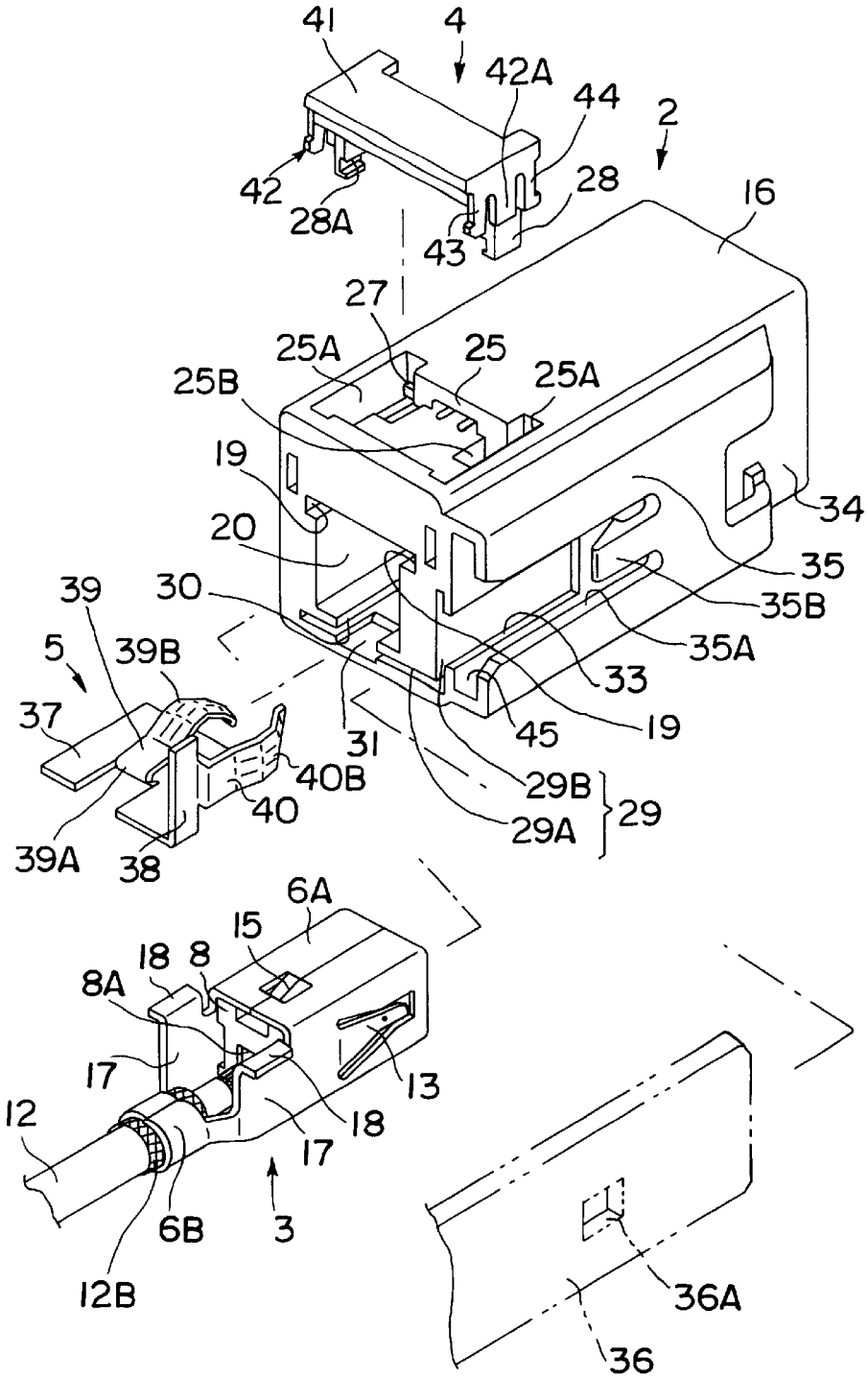
FIG. 1 is an exploded perspective view of a connector according to a first embodiment.

A connector in accordance with the subject invention is identified by the numeral 1 in FIGS. 1 to 14.

The connector 1 is comprised of a connector housing 2, an electrical connection element 3 to be substantially accommodated in the connector housing 2, a retainer 4 for locking the electrical connection element 3, and a ground terminal 5 to be brought into contact with an outer surface of the electrical connection element 3. This connector 1 is used to transmit high frequency signals.

In the following description, it is assumed that a direction of connection with a mating connector 10 (see FIG. 14) is a forward direction and a surface of the connector housing 2 in FIG. 1 where a retainer mount hole 25 is formed is an upper surface.

Figure 2:
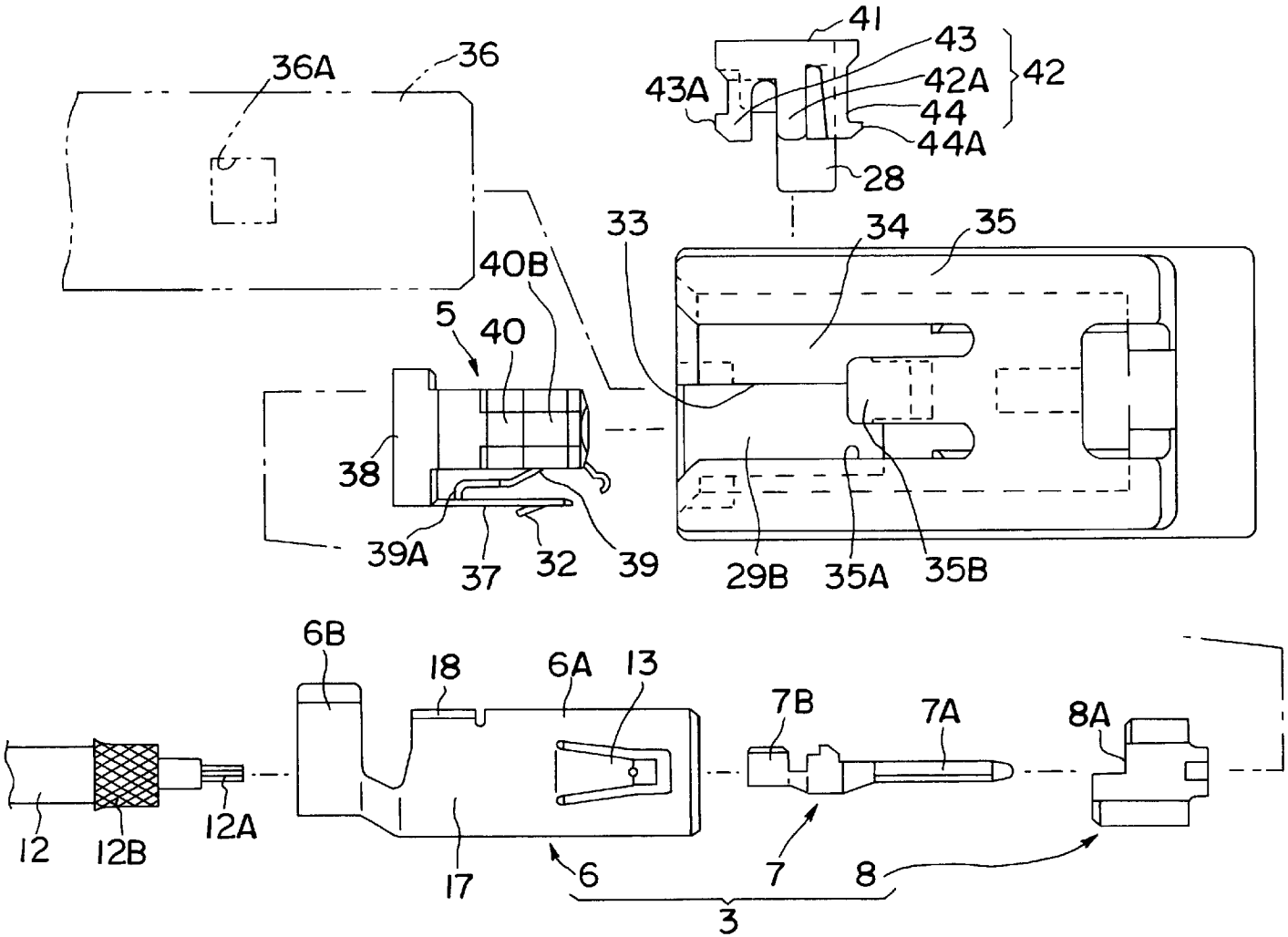
FIG. 2 is an exploded side view of the connector.
Figure 3:
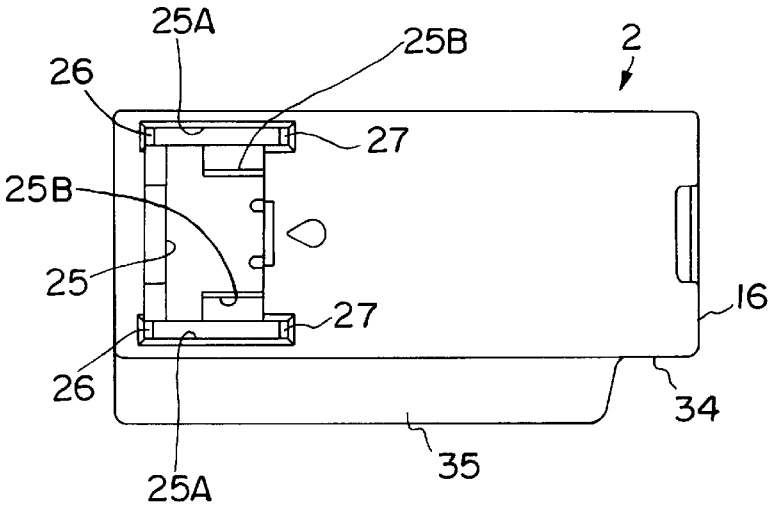
FIG. 3 is a plan view of a connector housing.
Figure 4:
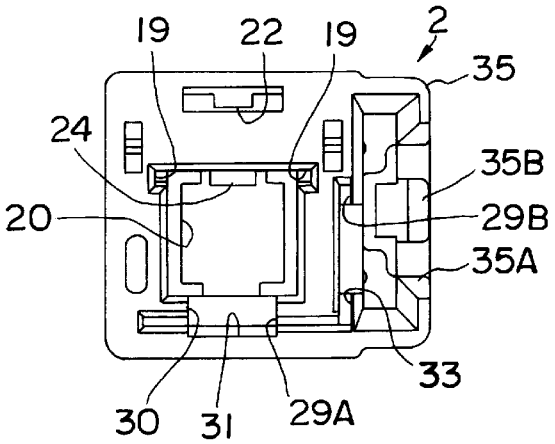
FIG. 4 is a rear view of the connector housing.
Figure 5:
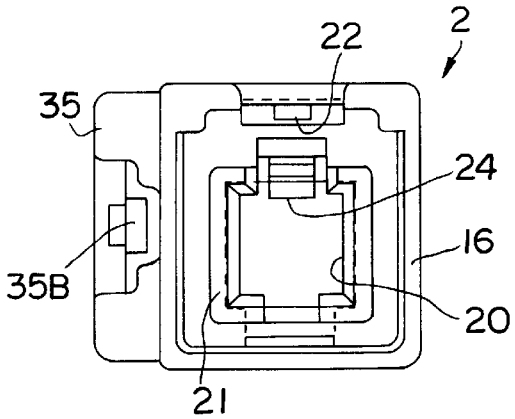
FIG. 5 is a front view of the connector housing.
Figure 6:
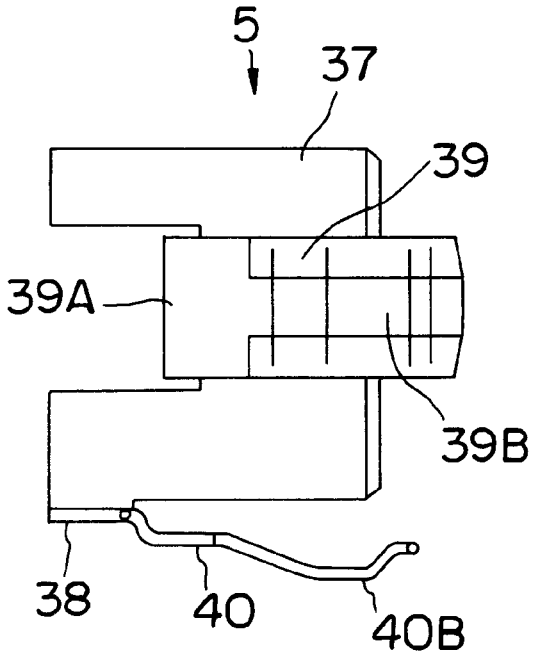
FIG. 6 is a plan view of a ground terminal.
Figure 7:
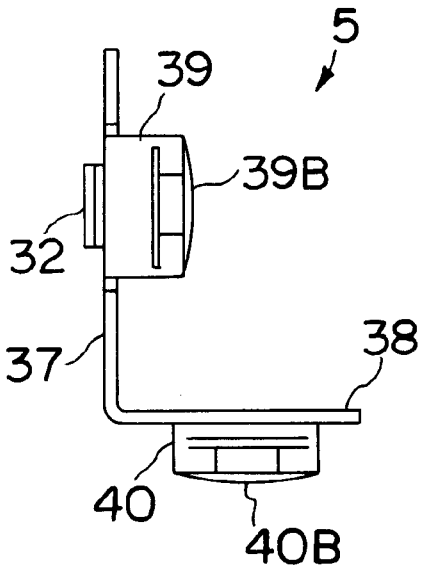
FIG. 7 is a rear view of the ground terminal.
Figure 8:
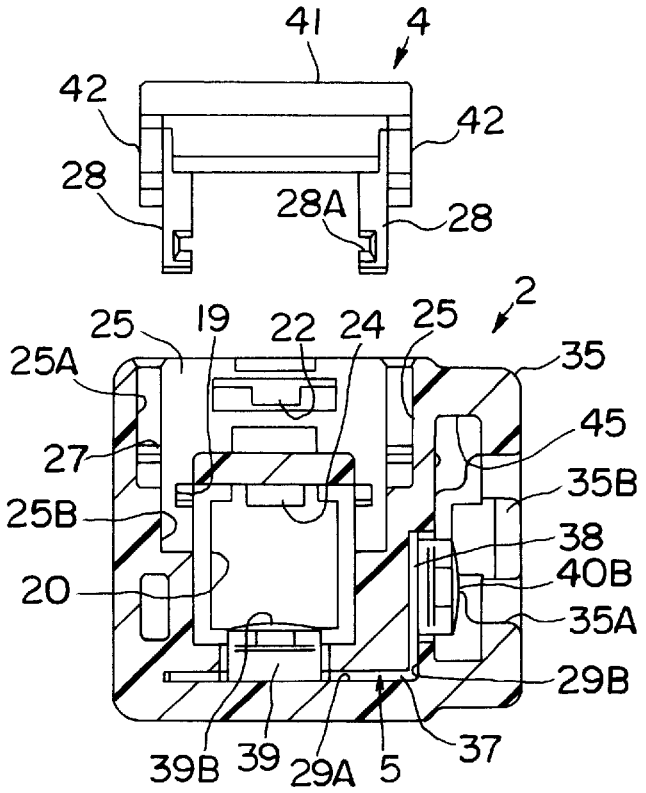
FIG. 8 is a section of the connector housing and a retainer before being assembled with each other.
Figure 9:
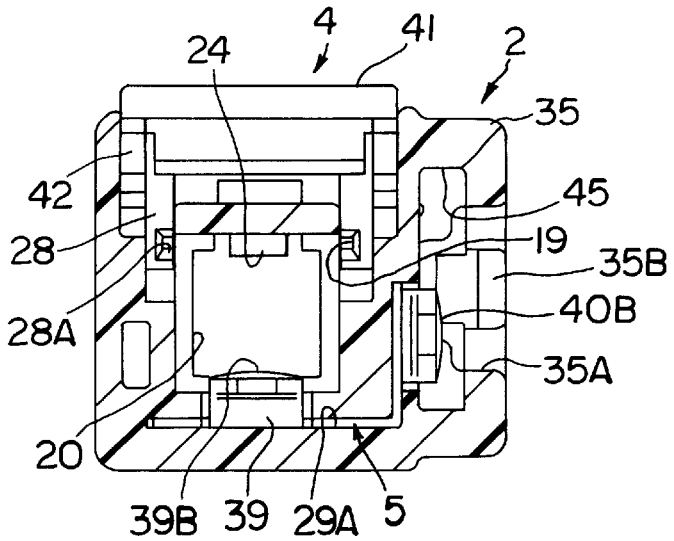
FIG. 9 is a section of the connector housing and the retainer when the retainer is in its partial locking position.
Figure 10:
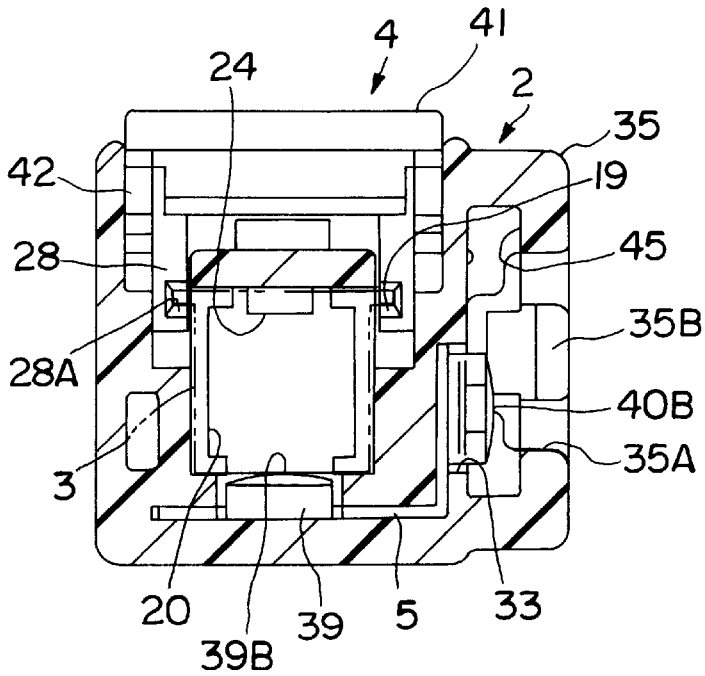
FIG. 10 is a section of an assembly of the connector housing, the retainer and an electrical connection element when the retainer is in its partial locking position.
Figure 11:
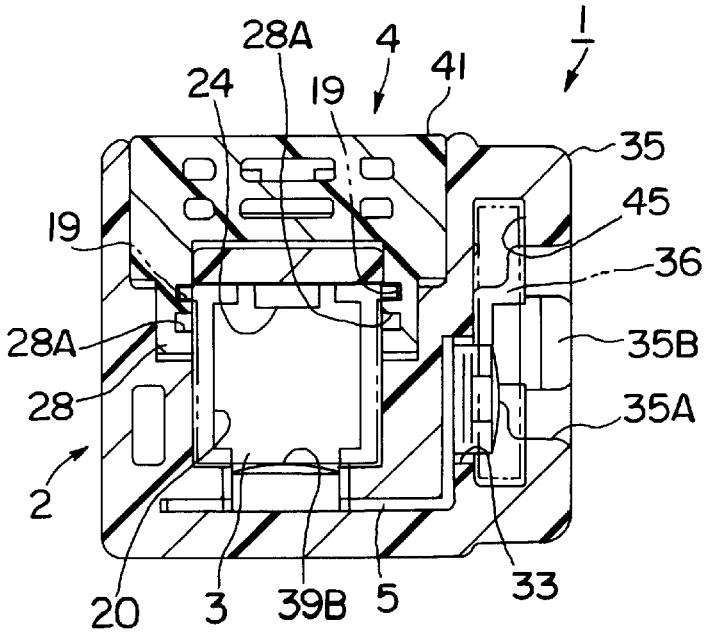
FIG. 11 is a section of the connector.

The electrical connection element 3, as shown in FIG. 2, is comprised of an outer terminal 6, an inner terminal 7 and an insulating member 8 for insulating the terminals 6 and 7 from each other.

The inner terminal 7 is a male side terminal which is connected with a core wire 12A of a shielded cable 12 to transmit high frequency signals. At the leading end of the inner terminal 7 is provided a tab portion 7A connectable with a mating inner terminal 9 (shown only in FIG. 14). At the rear end of the inner terminal 7, a barrel portion 7B connectable with the core wire 12A of the shielded cable 12 projects.

The outer terminal 6 is formed e.g. by bending a conductive plate, and a member receptacle 6A substantially in the form of a rectangular tube is provided at its front part. The insulating member 8 is at least partially mountable in the member receptacle 6A. At the left and right side walls of the member receptacle 6A are formed elastic contact portions 13 which are substantially elastically deformable. The elastic contact portions 13 can be elastically brought into contact with an outer surface of a mating outer terminal 14. A portion of the upper surface of the member receptacle 6A is cut and bent in an inward direction of the member receptacle 6A, thereby forming a member locking portion 15, which is to be engaged with the insulating member 8 to lock it in the member receptacle 6A. Behind the member receptacle 6A are formed push-in portions 18 by bending upper portions of left and right side walls 17 outward. The push-in portions 18 are pushed into grooves 19 to contribute to the stable mounting of the electrical connection element 3 when the electrical connection element 3 is pushed into the connector housing 2. The push-in portions 18 also act as engaging portions of the retainer 4 (to be described in detail later). A barrel portion 6B projects at the rear end of the outer terminal 6. The barrel portion 6B is fastened to a shield layer 12B of the shielded cable 12.

The insulating member 8 is integrally or unitarily formed by an insulating material and insulates the terminals 6 and 7 from each other by being mounted in the member receptacle 6A of the outer terminal 6 while accommodating the inner terminal 7 therein. The insulating member 8 is provided with a terminal receptacle 8A which penetrates through the insulating member 8 in forward and backward directions. In the upper surface of the insulating member 8 is formed an engaging recess 8B, with which the member locking portion 15 of the member receptacle 6A is engageable.

The connector 2 is integrally or unitarily made e.g. of synthetic resin and preferably has a substantially rectangular parallelepipedic shape, and is to be connected with the mating connector 10 while accommodating the electrical connection element 3 therein. At a front part of the connector housing 2 is provided a connector receptacle 16 for accommodating the mating connector 10. An inner tubular portion 21 projects forward from the back surface of the connector receptacle 16. The inner diameter of the inner tubular portion 21 is set slightly larger than the outer diameter of the outer terminal 6. A front half of the electrical connection element 3 can be accommodated in a space inside the inner tubular portion 21. Further, a locking projection 22 projects inwardly of the connector receptacle 16 from the upper wall of the connector receptacle 16. The locking projection 22 is engageable with a locking portion 23 of the mating connector 10 to lock the connectors 1 and 10 into each other. Inside the connector housing 22 is provided a connection element receptacle 20 for accommodating the electrical connection element 3. The receptacle 20 is open at its front and back and a front part thereof communicates with the inner space of the inner tubular portion 21. The rear opening of the receptacle 20 acts as a connection element insertion opening 20A. In the middle of the upper wall of the connection element receptacle 20 is provided a forward projecting locking portion 24. The locking portion 24 is vertically elastically deformable and elastically engageable with the electrical connection element 3. Further, a pair of grooves 19 are formed at the upper ends of the left and right walls of the receptacle 20. The push-in portions 18 of the outer terminal 6 can be pushed along the grooves 19.

In the upper surface of the connector housing 2 is formed the retainer mount hole 25 substantially communicating with the connection element receptacle 20. The retainer mount hole 25 has a substantially rectangular shape so as to conform to the horizontal section of the retainer 4 to be described later, and the left and right ends thereof project slightly forward. The left and right ends of the retainer mount hole 25 act as retainer locking slots 25A. Inside each slot 25A, two locking projections 26 and 27 project from the front and rear wall surfaces. The projections 26 projecting from the rear walls are partial locking projections 26 for holding the retainer 4 in its partial locking position, whereas the projections 27 projecting from the front walls are full locking projections 27 provided in positions substantially deeper than the corresponding partial locking projections 26 for holding the retainer 4 in its full locking position.

Inward of the retainer locking slots 25A are provided a pair of connection element locking slots 25B communicating with the grooves 19 of the connection element receptacle 20. Connection element locking portions 28 of the retainer 4 to be described later are insertable into the slots 25B.

Below the connection element insertion opening 20A is provided a ground terminal receptacle 29 into which the ground terminal 5 is insertable. In other words, the ground terminal 5 and the aforementioned retainer 4 are mounted on opposing planes above and below the electrical connection element 3 in the connection element receptacle 20. The ground terminal receptacle 29 is comprised of a horizontal slot 29A which is transversely wider than the insertion opening 20A and a vertical slot 29B extending upward from the right end of the horizontal slot 29A and, accordingly, has a substantially L-shaped cross section as a whole. In the middle of the bottom wall of the insertion opening 20A is formed a notch 30 which extends forward from the rear edge. This notch 30 communicates with the horizontal slot 29A. Further, a recess 31 is formed in the middle of the bottom wall of the horizontal slot 29A. A locking piece 32 of the ground terminal 5 to be described later is engageable with the recess 31. In a right side wall 34 of the connector housing 2 in FIG. 1 is formed a notch 33 which extends forward from the rear end. This notch 33 communicates with the vertical slot 29B.

A connector engaging portion 35 is so provided on the right side wall 34 as to substantially cover the notch 33. The connector engaging portion 35 is comprised of two sections which extend outward from the upper and lower edges of the right side wall 34 and are bent down and up so that the leading ends thereof extend toward each other. Accordingly, the connector engaging portion has a substantially channel-shaped cross section. The upper and lower leading edges of the connector engaging portion 35 are spaced apart by a specified distance to define a groove 35A. Further, a claw 35B projects backward from the front end of the groove 35A. The claw 35B is elastically deformable along the transverse direction of the connector housing 2. A space inside the connector engaging portion 35 acts as a grounding member receptacle 45 in which a grounding member 36 is mountable.

The grounding member 36 is made e.g. of a conductive plate and has an engaging hole 36A formed at one end thereof. When this portion of the grounding member 36 is accommodated in the grounding member receptacle 45, the claw 35B is engaged with the engaging hole 36A to lock the grounding member 36. Although unillustrated, an assembling hole is formed at the other end of the grounding member 36. By fastening a screw into this assembling hole, the grounding member 36 is fixed in a position of grounding.

The ground terminal 5 is formed e.g. by bending a conductive plate and is pushed into the ground terminal receptacle 29 of the connector housing 2 to electrically connect the outer terminal 6 and the grounding member 36. The ground terminal 5 is provided with two push-in portions 37 and 38 which are substantially at a right angle to each other. The horizontal push-in portion 37 can be pushed into the horizontal slot 29A. The vertical push-in portion 38 is formed by bending the right end of the horizontal push-in portion 37 upward and can be pushed into the vertical slot 29B. In a middle rear portion of the horizontal push-in portion 37 is formed a forward projecting elastic contact piece 39 by bending. A base end 39A of the elastic contact piece 39 is located substantially in the middle of the horizontal push-in portion 37. When the ground terminal 5 is mounted in the ground terminal receptacle 29, the horizontal push-in portion 37 is fitted into the notch 30 of the connector housing 2, with the result that the elastic contact piece 39 substantially faces the connection element receptacle 20. The elastic contact piece 39 is vertically elastically deformable in a space defined between a bottom part of the connection element receptacle 20 and an upper part of the ground terminal receptacle 29. Further, a middle part of the elastic contact piece 39 bulges out upward with a specified curvature, and the leading end thereof is bent downward. A contact portion 39B having this curvature can be brought into contact with the outer terminal 6. The downward projection locking portion or piece 32 is provided in the middle of a front part of the horizontal push-in portion 37. This locking portion 32 is fitted into the recess 31 of the connector housing 2 to lock the ground terminal 5.

The vertical push-in portion 38 is shorter than the horizontal push-in portion 37 in a dimension substantially along forward and backward directions. A second elastic contact pieces 40 substantially projects forward from the middle of the vertical push-in portion 38. The second elastic contact piece 40 is transversely elastically deformable, and a middle portion thereof toward the leading end bulges out rightward with a specified curvature while the leading end thereof is bent toward the left again. When the vertical push-in portion 38 is pushed into the vertical slot 29B, the second elastic contact piece 40 is fitted into the notch 33 and a curved contact portion 40B faces the inner space of the connector engaging portion 35. The contact portion 40B can be elastically brought into surface contact with the grounding member 36.

The retainer 4 is integrally or unitarily made e.g. of synthetic resin and is to be mounted in the connector housing 2 to lock the electrical connection element 3. The retainer 4 is provided with a flat base 41 at the top, a pair of locking legs 42 extending down from the left and right ends of the base 41, and a pair of connection element locking portions 28 extending down from the base 41 in more inward positions than the locking legs 42. The base 41 preferably has a substantially rectangular shape, and its left and right ends project slightly forward, and the locking legs 42 are provided on the lower surface of the left and right ends of the base 41. Each locking leg 42 is comprised of a center portion 42A and leg portions 44, 43 provided before and behind the center portion 42A, respectively. The leg portions 43, 44 are elastically deformable in directions closer to each other, and locking claws 43A, 44A project from the leading ends of the leg portions 43, 44 so as to be engageable with the locking projections 26, 27 of the retainer locking slots 25A.

Figure 12:
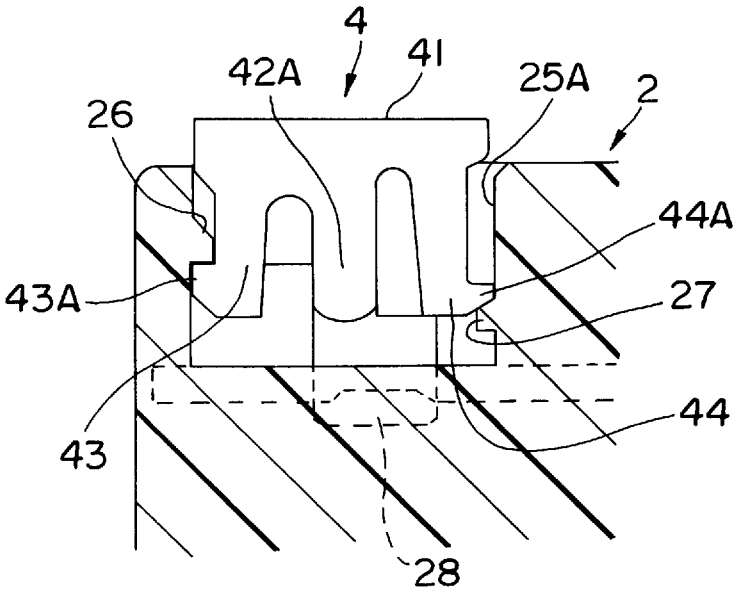
FIG. 12 is an enlarged section showing a locking part of the retainer in the assembly of the connector housing and the retainer when the retainer is in its partial locking position.
Figure 13:
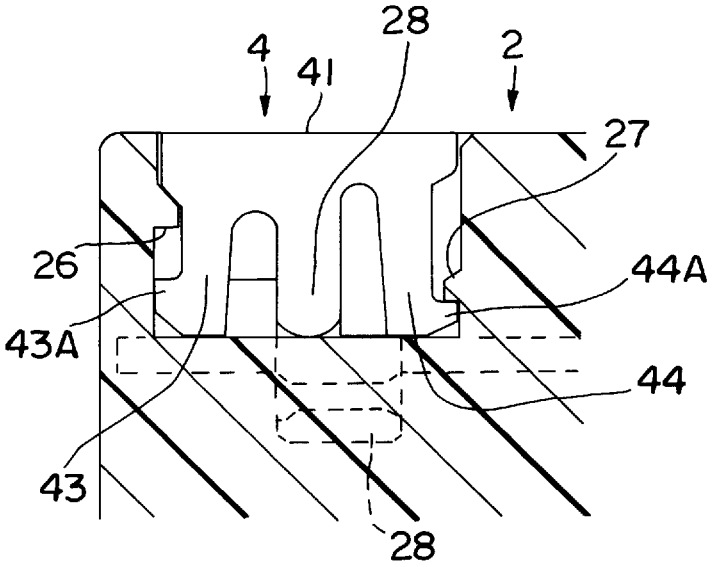
FIG. 13 is an enlarged section showing the locking part of the retainer in the assembly of the connector housing and the retainer when the retainer is in its full locking position.
Figure 14:
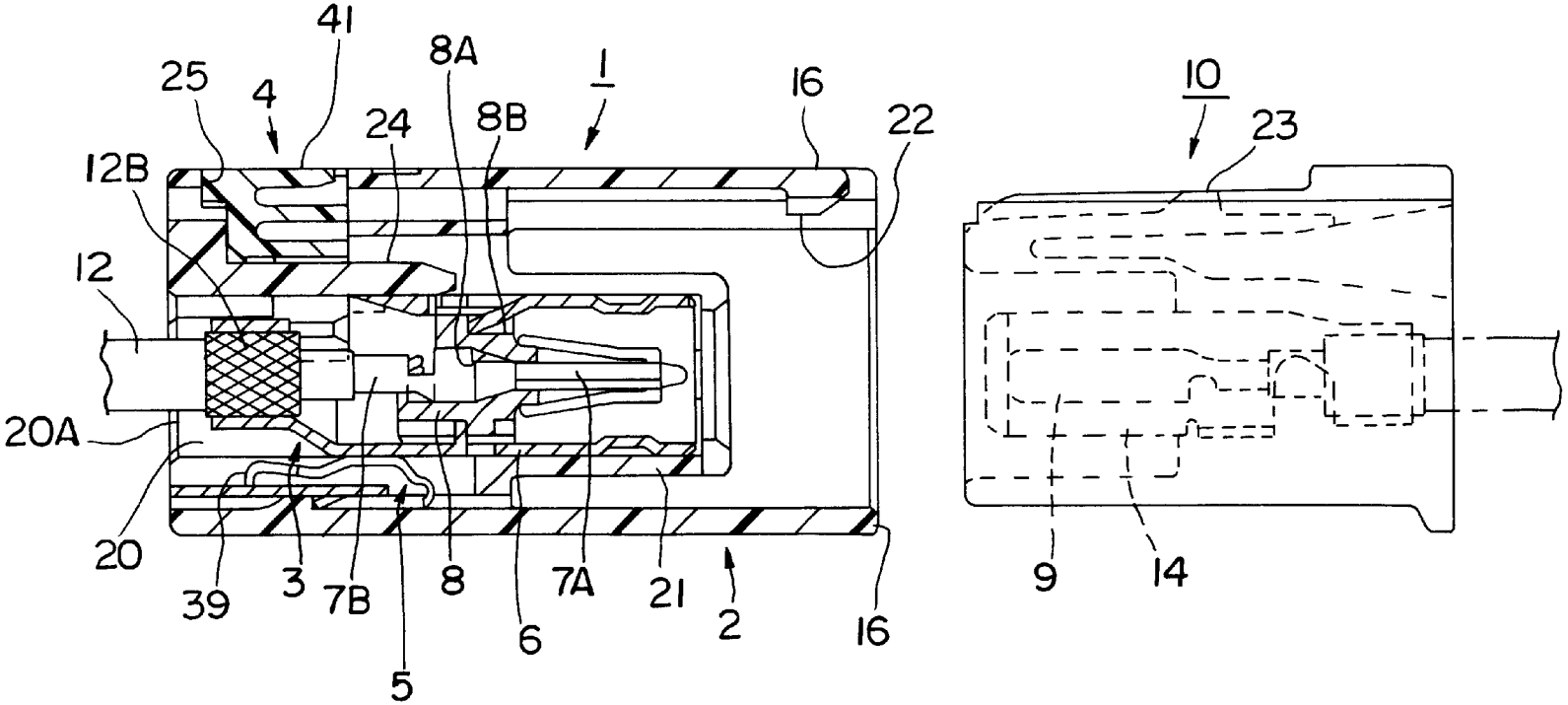
FIG. 14 is a side view in section of the connector and a mating connector before being connected with each other.

Specifically, the partial locking claws 43A of the rear partial locking leg portions 43 are engaged with the partial locking projections 26 to hold the retainer 4 in its partial locking position (see FIG. 12). At this time, the front part of the retainer 4 is held by the contact of the leading ends of the full locking claws 44A of the full locking leg portions 44 with the full locking projections 27. When the retainer 4 is further pushed to engage the full locking claws 44A of the full locking leg portions 44 at the front side with the full locking projections 27, the retainer 4 is held in its full locking position (see FIG. 13).

The connection element locking portions 28 extend more downward than the locking legs 42 and can enter the connection element receptacle 20 through the connection element locking slots 25B. Interference avoiding grooves 28A are formed in the opposing surfaces of the respective locking portions 28 near the leading ends thereof. The width of the interference avoiding grooves 28A are substantially equal to that of the grooves 19 of the connector housing 2. When the retainer 4 is in its partial locking position, the interference avoiding grooves 28A are substantially in alignment with the grooves 19 and the insertion and withdrawal of the electrical connection element 3 into and from the connection element receptacle 20 are permitted (see FIG. 10). When the retainer 4 is in its full locking position, the interference avoiding grooves 28A are located below the grooves 19 and the grooves 19 are substantially interrupted (see FIG. 11). In this state, the leading ends of the locking portions 28 are engaged with the rear edges of the push-in portions 18 of the outer terminal 6, thereby locking the electrical connection element 3 by the retainer 4 (see FIG. 14).

First, how the electrical connection element 3 is assembled is described. The insulating member 8 is inserted into the member receptacle 6A preferably from front of the outer terminal 6. The insulating member 8 is locked in the outer terminal 6 by the engagement of the member locking portion 15 of the member receptacle 6A with the engaging recess 8B. Subsequently, the inner terminal 7 connected with the core wire 12A in advance is at least partially accommodated into the terminal receptacle 8A of the insulating member 8. Consequently, the barrel portion 6B of the outer terminal 6 is fastened to the shield layer 12B, thereby completing the assembling of the electrical connection element.

Next, the ground terminal 5 is assembled with the connector housing 2. The ground terminal 5 is pushed while the horizontal and vertical push-in portions 37, 38 are aligned with the horizontal and vertical slots 29A, 29B of the ground terminal receptacle 29. When the locking portion 32 of the ground terminal 5 is fitted into the recess 31, the ground terminal 5 is lockingly held (see FIG. 8). At this time, the elastic contact piece 39 of the ground terminal 5 and the second elastic contact piece 40 project into the connection element receptacle 20 and into the connector locking portion 35, respectively.

Next, the retainer 4 is mounted into the retainer mount hole 25 of the connector housing 2. After the locking legs 42 and the connection element locking portions 28 of the retainer 4 are fitted into the retainer locking slots 25A and the connection element locking slots 25B of the retainer mount hole 25, the base 41 of the retainer 4 is pushed. Then, the partial locking leg portions 43 are deformed in directions closer to each other and the partial locking claws 43A move over the partial locking projections 26. When the partial locking leg portions 43 are restored to their original shapes, the retainer 4 reaches its partial locking position (see FIGS. 9 and 12).

Here, the insertion of the electrical connection element 3 through the connection element insertion opening 20A is started. At this time, the push-in portions 18 of the outer terminal 6 are pushed into the grooves 19 of the connector housing 2. In the partial locking position, the interference avoiding grooves 28A formed in the connection element locking portions 28 are in alignment with the grooves 19 and, accordingly, the retainer 4 permits the insertion of the electrical connection element 3. The electrical connection element 3 is inserted while the member receptacle 6A of the outer terminal 6 is deflecting the locking portion 24 upward. When the member receptace 6A moves beyond the locking portion 24, the locking portion 24 is restored to its original shape to engage the rear edge of the member receptacle 6A, with the result that the electrical connection element 3 is locked by the locking portion 24 (see FIG. 10). At the bottom surface of the outer terminal 6, the elastic contact piece 39 is in surface contact with the outer terminal 6 while being elastically deformed downward. Further, the front part of the electrical connection element 3 is accommodated in the inner tubular portion 21 of the connector housing 2.

Subsequently, the retainer 4 is further pushed to bring the full locking claws 44A in contact with the full locking projections 27, thereby elastically deforming the full locking leg portions 44 in the directions closer to each other. When the full locking claws 44A move over the full locking projections 27, the full locking leg portions 44 are restored to their original shapes and the full locking claws 44A are engaged with the full locking projections 27. In this way, the retainer 4 reaches its full locking position (see FIGS. 11 and 13). At this time, the connection element locking portions 28 of the retainer 4 are pushed to the positions where the interference avoiding grooves 28A are displaced downward from the grooves 19 and, accordingly, the push-in portions 18 of the electrical connection element 3 are locked. After the assembling of the connector 1 is completed in this way, the connector 1 is connected with the mating connector 10 (see FIG. 14).

Inside the connector locking portion 35, the grounding member 36 is inserted to be elastically brought into contact with the second elastic contact piece 40. In this way, the outer terminal 6 and the grounding member 36 are connected via the ground terminal 5, thereby grounding the outer terminal 6.

According to this embodiment, since the retainer 4 is assembled at the side of the electrical connection element 3 opposite from the ground terminal 5, it can be constructed as a so-called side retainer.

In the case that the connector 1 is used for high frequency signals, it is empirically known that a contact portion between the ground terminal 5 and the electrical connection element 3 is better to be a surface than to be a point since the surface contact ensures a satisfactory high frequency characteristic. In order to provide a surface contact portion, the elastic contact piece 39 more easily tolerates a molding error of the connector 1 than a mere projection.

If an attempt is made to provide the ground terminal 103 inserted from one side of the connector housing 104 with an elastic contact piece as in the prior art, the transverse dimension of the connector housing 104 has to be increased due to the necessity to provide a deformation permitting space for the insertion of the ground terminal 103. In this embodiment, the ground terminal receptacle 29 is open in the rear surface of the connector housing 2. Accordingly, if the deformation permitting space for the elastic contact piece 39 is provided taking advantage of the connection element receptacle 28, the elastic contact piece 39 can be easily provided on the ground terminal 5 without increasing the size of the connector housing 2.

Further, since the electrical connection element 3 is comprised of the inner terminal 7, the outer terminal 6, and the insulating member 8 provided between the outer and inner terminals 6 and 7, it is difficult to provide such a locking portion as to project into the space inside the outer terminal unlike a side retainer of a usual connector. In this embodiment, by forming the push-in portions 18 to project from the outer terminal 6 of the electrical connection element 3 and using them to lock the retainer 4, such a construction as to project into the inner space of the outer terminal 6 can be avoided.

Furthermore, since the push-in portions 18 are pushed into the grooves 19 of the connection element receptacle 20, they also contribute to the stable mounting of the electrical connection element 3.

Next, a second embodiment of the invention is described with reference to FIGS. 15 to 30. It should be noted that the same or similar construction as the first embodiment is not partly described by being identified by the same reference numerals.

Figure 15:
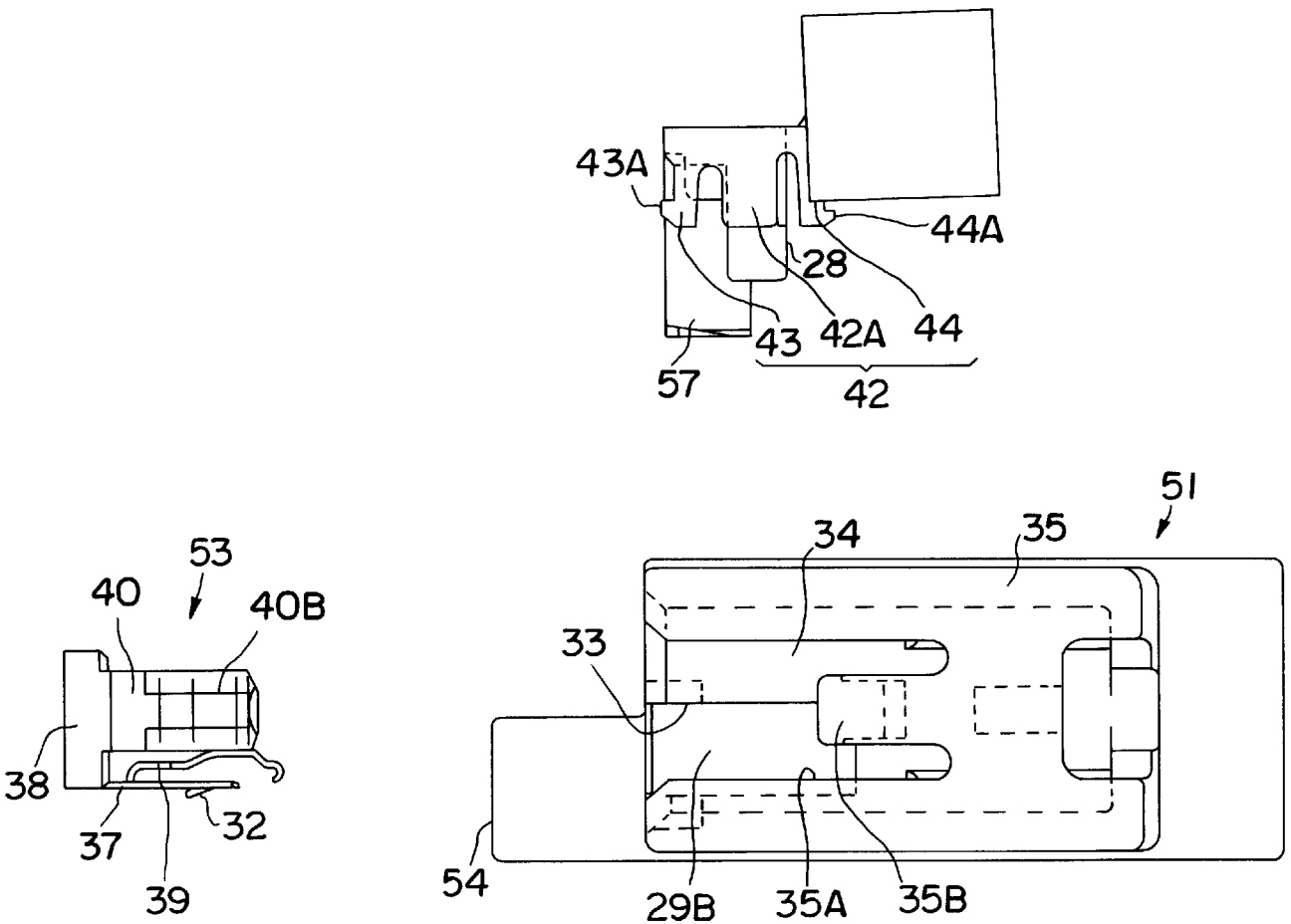
FIG. 15 is an exploded side view of a connector according to a second embodiment.
Figure 16:
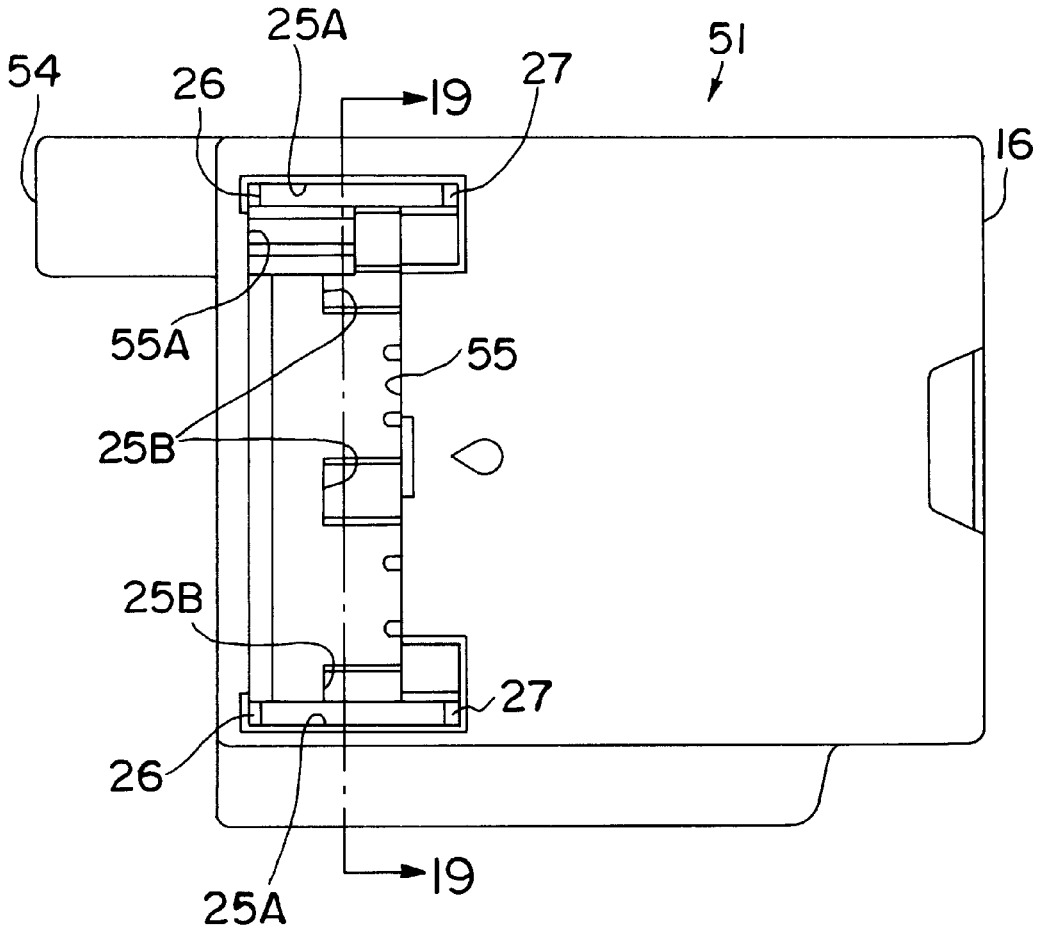
FIG. 16 is a side view of a connector housing.
Figure 17:
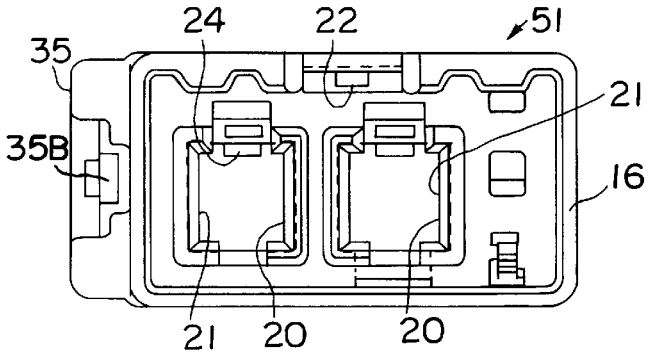
FIG. 17 is a front view of the connector housing.
Figure 18:
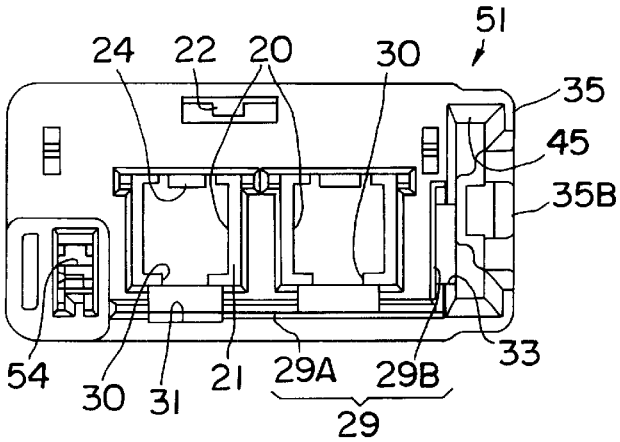
FIG. 18 is a rear view of the connector housing.
Figure 19:
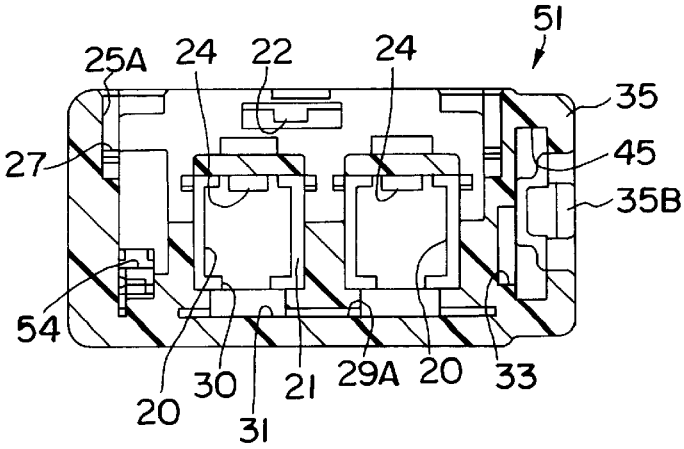
FIG. 19 is a section along A—A of FIG. 15.
Figure 20:
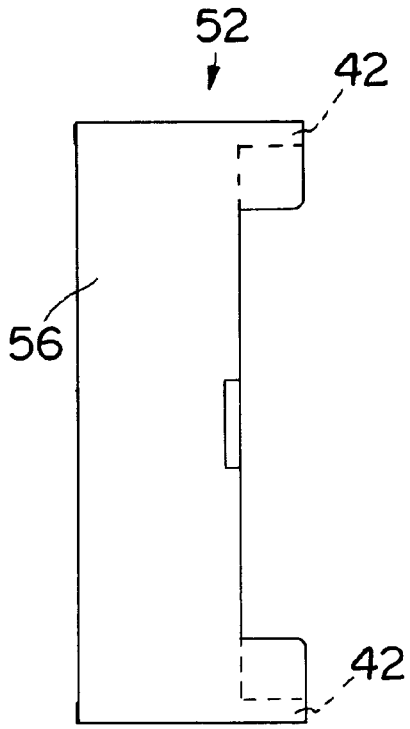
FIG. 20 is a plan view of a retainer.
Figure 21:
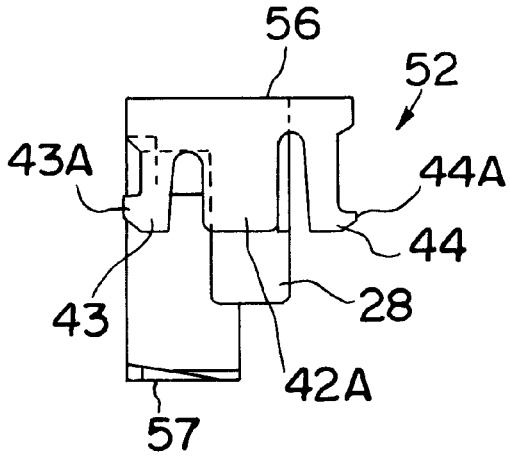
FIG. 21 is a side view of the retainer.

As shown in FIG. 15, a connector 50 is comprised of a connector housing 51, a retainer 52 and a ground terminal 53. The connector housing 51 is provided with e.g. two substantially side-by-side arranged connection element receptacles 20 for accommodating electrical connection elements 3. Further, at the left side of the left connection element receptacle 20 in FIG. 19 is provided a terminal receptacle 54 for accommodating a usual terminal fitting (not shown, but similar to the inner terminal 7 to be connected with one end of a cable comprised only of a core wire). A portion of the connector housing 51 around the terminal receptacle 54 substantially projects more backward than connection element insertion openings 20A of the connection element receptacles 20.

In the upper surface of the connector housing 51 is provided a retainer mount hole 55 communicating with the connection element receptacle 20. At the left and right ends of the retainer mount hole 55 are formed a pair of retainer locking slots 25A. The retainer mount hole 55 is also formed with connection element locking slots 25B substantially communicating with the two connection element receptacles 20. The locking slot 25B formed in a wall provided between two adjacent connection element receptacles 20 has a width equal to a sum of the widths of the remaining two locking slots 25B. In other words, three locking slots 25B substantially communicating with the respective connection element receptacles 20 are provided in the retainer mount hole 55. Further, a terminal locking slot 55A is provided below the upper retainer locking slot 25A in FIG. 16. This slot 55A substantially communicates with the terminal receptacle 54.

A horizontal slot 29A of a ground terminal receptacle 29 has such a width as to extend over the two connection element receptacles 20. A recess 31 is formed only below the connection element receptacle 20 at the left side in FIG. 19.

Figure 22:
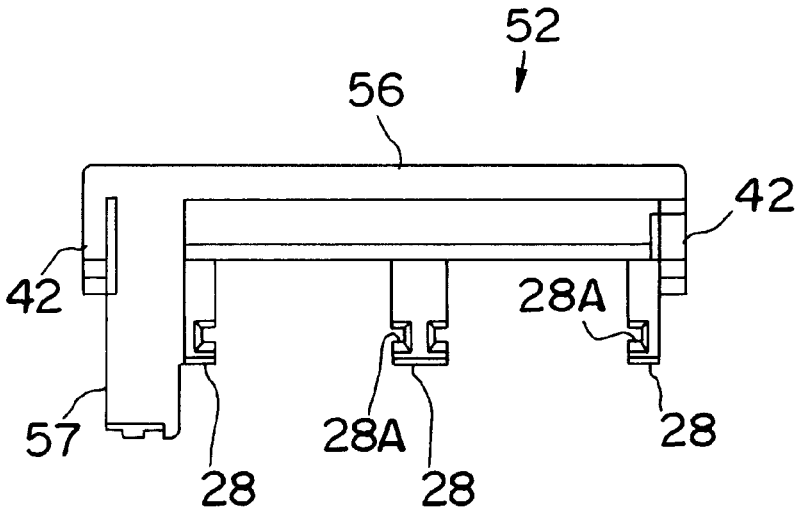
FIG. 22 is a front view of the retainer.
Figure 23:
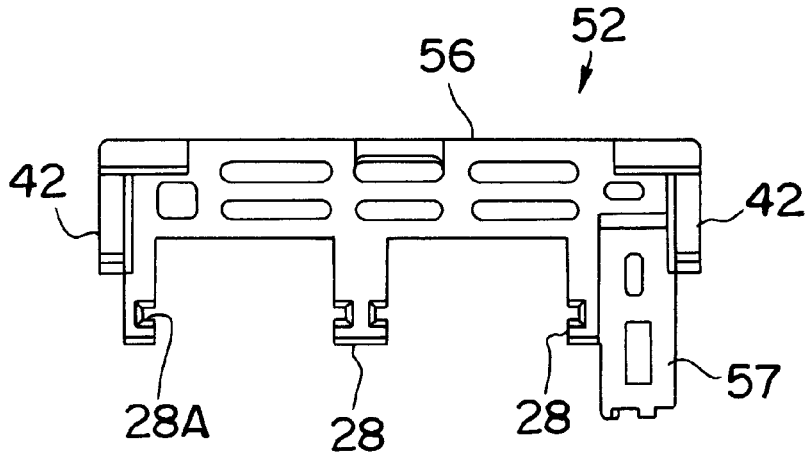
FIG. 23 is a rear view of the retainer.
Figure 24:
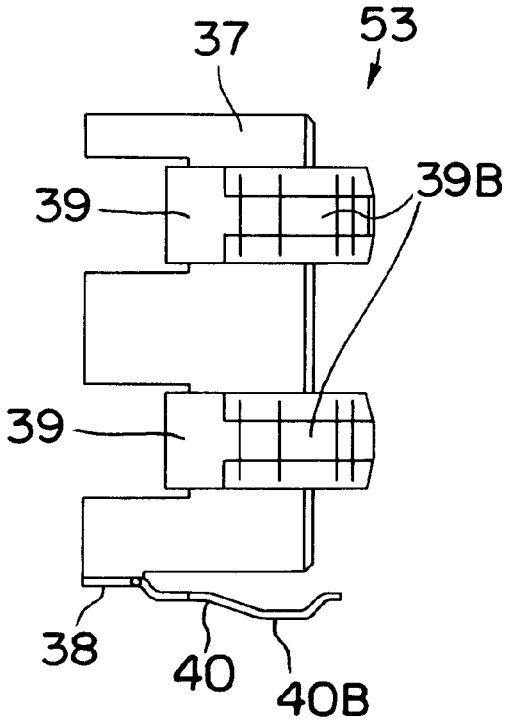
FIG. 24 is a plan view of a ground terminal.
Figure 25:
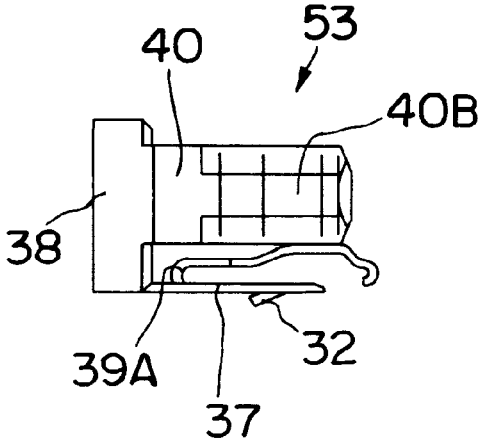
FIG. 25 is a side view of the ground terminal.
Figure 26:
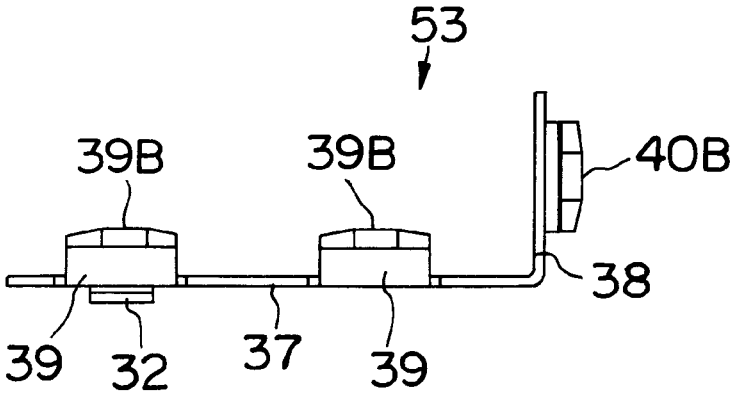
FIG. 26 is a rear view of the ground terminal.
Figure 27:
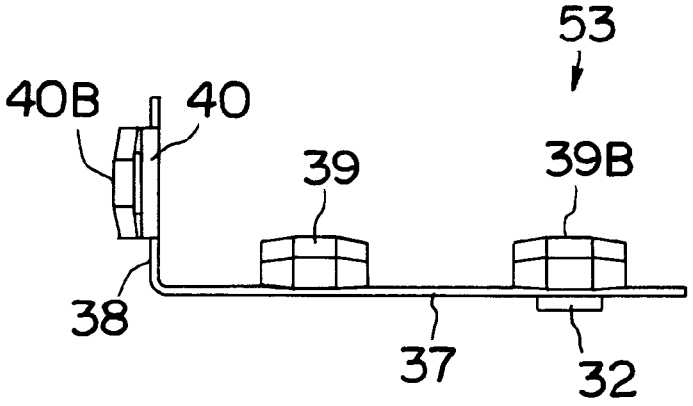
FIG. 27 is a front view of the ground terminal.
Figure 28:
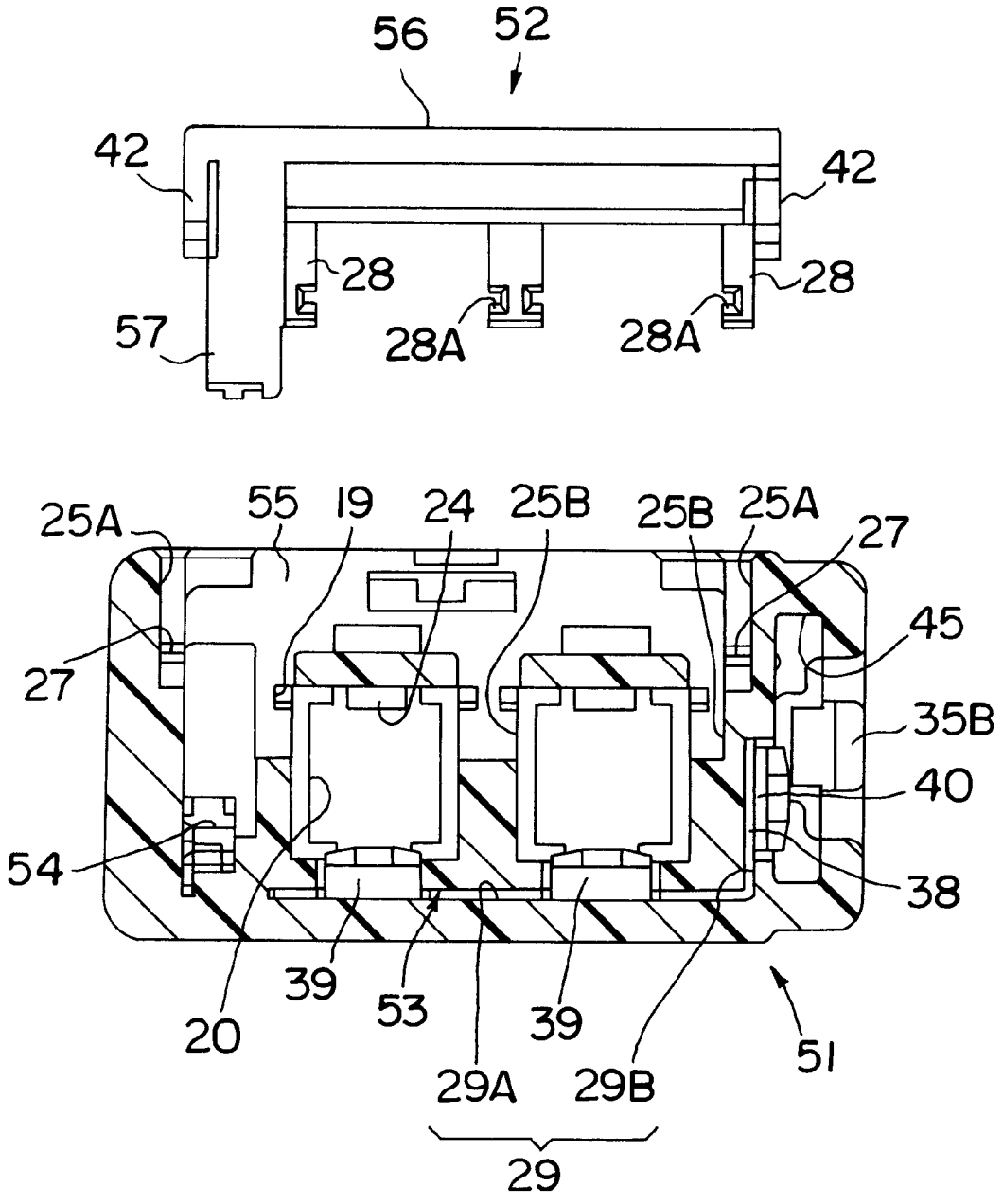
FIG. 28 is a section of the connector housing and the retainer before being assembled with each other.
Figure 29:
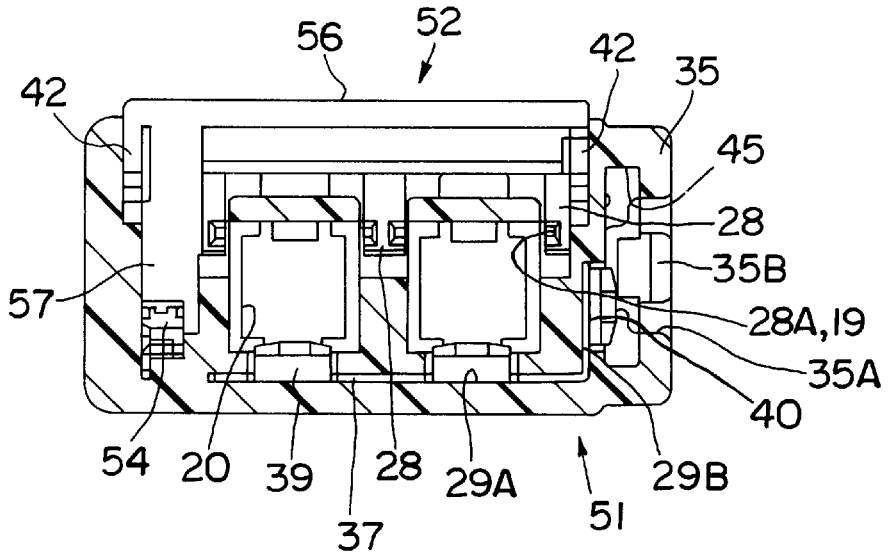
FIG. 29 is a section of the connector housing and the retainer when the retainer is in its partial locking position.
Figure 30:
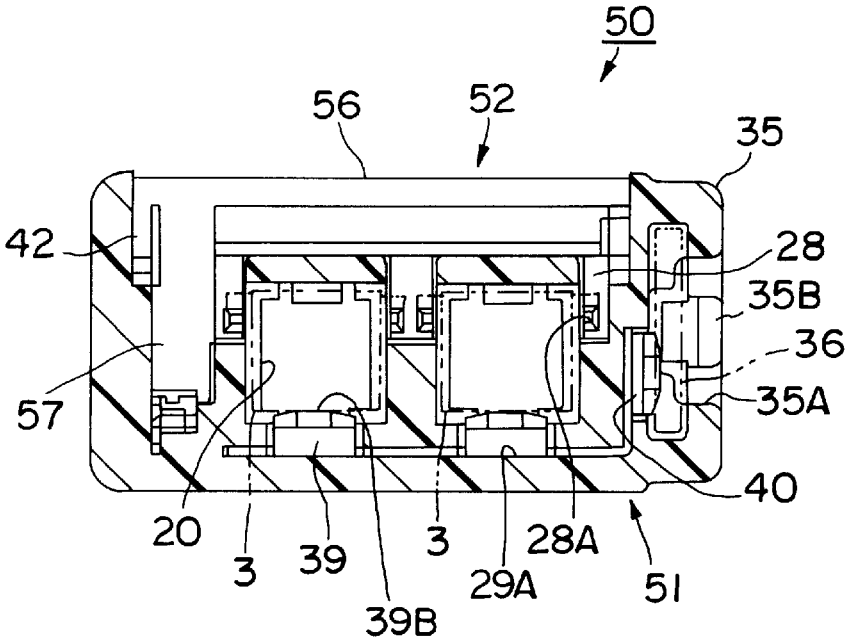
FIG. 30 is a section of the connector housing and the retainer when the retainer is in its full locking position.
Figure 31:
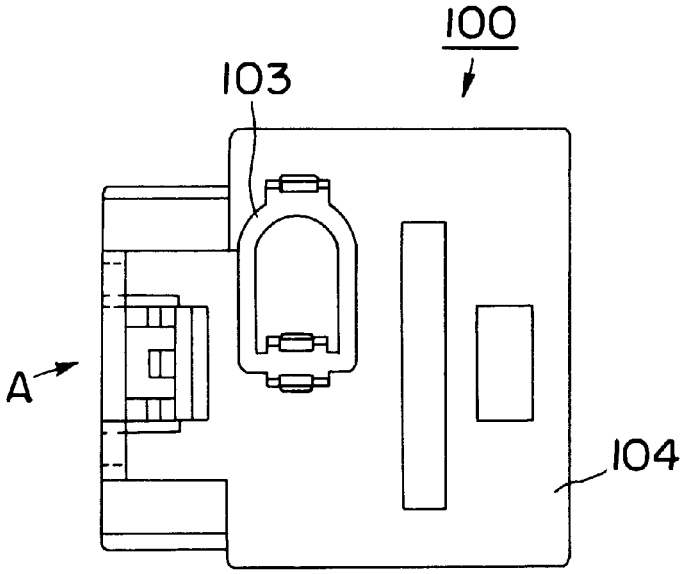
FIG. 31 PRIOR ART
FIG. 31 is a bottom view of a prior art connector.
Figure 32:
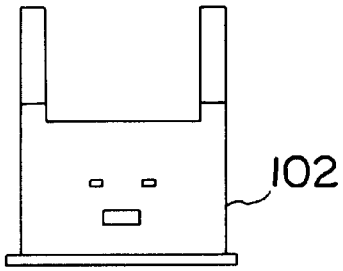
FIG. 32 PRIOR ART
FIG. 32 is a bottom view of a retainer of the prior art connector.
Figure 33:
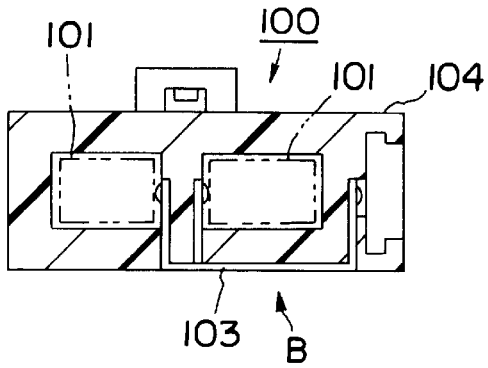
FIG. 33 PRIOR ART
FIG. 33 is a front view of a ground terminal of the prior art connector.
Figure 34:
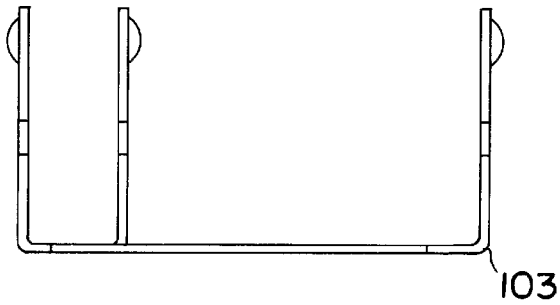
FIG. 34 PRIOR ART
FIG. 34 is a plan view of the ground terminal of the prior art connector.
Figure 35:
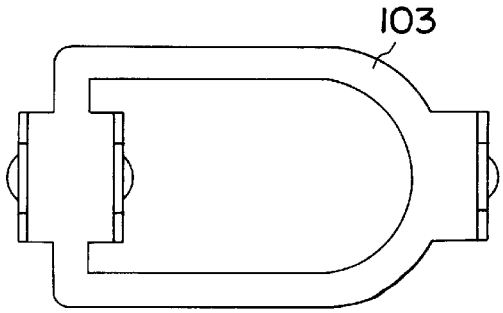
FIG. 35 PRIOR ART
FIG. 35 is a section of the prior art connector.

The retainer 52 is comprised of a base 56 for covering the retainer mount hole 55, a pair of locking leg portions 42 extending from the left and right ends of the base 56, and connection element locking portions 28 extending in conformity with the positions of the respective locking slots 25B. The middle one of the three connection element locking portions 28 has a thickness which is equal to a sum of the thicknesses of the two connection element locking portions 28 of the first embodiment, and has interference avoiding grooves 28A formed in its opposite side surfaces. At the right side of the left locking leg 42 in FIG. 22 is provided a terminal locking portion 57 which extends to a bottom most position. This terminal locking portion 57 is engaged with the unillustrated terminal fitting to lock it. When the retainer 52 is in its partial locking position, the terminal locking portion 57 is located in a position where it permits the insertion and withdrawal of the terminal fitting into and from the terminal receptacle 54. When the retainer 52 reaches its full locking position, the terminal locking portion 57 comes into engagement with the terminal fitting.

A horizontal push-in portion 37 of the ground terminal 53 is so formed as to conform to the width of the horizontal slot 29A and can be brought into contact with the electrical connection elements 3 to be mounted in the two connection element receptacles 20. In other words, the horizontal push-in portion 37 of the ground terminal 5 of the first embodiment is extended upward in FIG. 24, and another elastic contact piece 39 is provided. A locking piece 32 projects only from the elastic contact piece 39 at the left side of FIG. 26 in conformity with the position of the recess 31.

The second embodiment thus constructed has substantially the same action and effects as the first embodiment.

The present invention is not limited to the foregoing embodiments. For example, the following embodiments are also embraced by the technical scope of the present invention as defined in the claims.

Although a male terminal is shown as the inner terminal in the foregoing embodiment, the inner terminal may also be a female terminal according to the invention.

The retainer may be directly engaged with the member receptacle of the outer terminal without being engaged with the push-in portions projecting sideways from the outer terminal.

What is claimed is:

1. A connector, comprising:

a connector housing comprising opposed front and rear ends and a plurality of outer side walls extending between the ends, the outer side walls including opposite first and second outer side walls, at least one connection element receptacle extending through the connector housing from the front end to the rear end, a ground terminal receptacle extending into the rear end of the connector housing and disposed between the connection element receptacle and the first outer side wall of the connector housing, a retainer mount hole extending through the second outer side wall and into communication with the connection element receptacle;

an electrical connection element connected with a shielded cable and being accommodated in the connection element receptacle of the connector housing;

a ground terminal mounted in the ground terminal receptacle adjacent the first outer side wall of the connector housing, the ground terminal having a contact piece communicating with the connection element receptacle so as to contact one side surface of the electrical connection element; and a retainer insertable into the retainer mount hole in the second outer side wall of the connector housing, the retainer having locking portions extending into the connection element receptacle to lock the electrical connection element in the connection element receptacle, such that the ground terminal and the retainer are on opposite sides of the connection element receptacle.

2. A connector according to claim 1, wherein the connection element receptacle is a first connection element receptacle, and wherein the connector housing further comprises a second connection element receptacle disposed between the first and second outer side walls of the connector housing, the retainer mount hole communicating with both said first and second connection element receptacles, the electrical connection element being a first electrical connection element disposed in the first connection element receptacle, the connector further comprising a second electrical connection element disposed in the second connection element receptacle, the contact piece of the ground terminal being a first contact piece and being disposed in the first connection element receptacle, the ground terminal further comprising a second contact piece disposed in the second connection element receptacle for grounding contact with the second electrical connection element.

3. A connector according to claim 1, wherein the electrical connection element comprises an inner terminal connected with a core wire of the shielded cable, an outer terminal connected with a shield layer of the shielded cable, and an insulating member for insulating the inner and outer terminals from each other.

4. A connector according to claim 3, wherein the outer terminal comprises push-in portions which project substantially sideways from the outer terminal and can be pushed into grooves formed in inner walls of the connection element receptacle, and wherein the retainer locks the electrical connection element by being engaged with the push-in portions.

5. A connector according to claim 1, wherein the connector housing is unitarily molded from a resin material.

6. A connector according to claim 5, wherein the connector housing comprises an internal wall between the connection element receptacle and the ground terminal receptacle, a notch being formed in the internal wall at the rear end of the connector housing, the contact piece of the ground terminal extending through the notch and being disposed between the electrical connection element and the internal wall.

7. A connector according to claim 6, wherein the contact piece of the ground terminal is elastically deformable, and is elastically deformed by contact with the electrical connection element.

8. A connector according to claim 5, wherein the connector housing further comprises a grounding member receptacle extending into the rear end of the connector housing and communicating with the ground terminal receptacle, the ground terminal having a portion extending into the grounding member receptacle for electrical contact with a grounding member inserted into the grounding member receptacle for grounding the electrical connection element.

9. A connector according to claim 8, wherein the plurality of outer side walls of the connector housing further comprise third and fourth outer side walls spaced from one another and extending respectively between the first and second side walls, the grounding member receptacle being disposed between the third side wall and the connection element receptacle.

10. A connector according to claim 9, wherein the ground terminal receptacle comprises a first slot disposed between the first outer side wall and the connection element receptacle and a second slot disposed between the grounding member receptacle and the connection element receptacle, the first and second slots being in communication with one another, the grounding terminal having a first portion disposed in the first slot and a second portion disposed in the second slot.

* * * * *